US005877111A

United States Patent [19]

Bennett et al.

[11] Patent Number: 5,877,111

[45] Date of Patent: Mar. 2, 1999

[54] COVERS FOR THERMAL TRANSFER PRINTS

[75] Inventors: Christopher Bennett, Brantham; Thomas Donald McLean, Burnt Heath, both of United Kingdom

[73] Assignee: Imperial Chemical Industries PLC, Millbank, United Kingdom

[21] Appl. No.: 716,270

[22] PCT Filed: Mar. 28, 1995

[86] PCT No.: PCT/GB95/00691

§ 371 Date: Sep. 24, 1996

§ 102(e) Date: Sep. 24, 1996

[87] PCT Pub. No.: WO95/26273

PCT Pub. Date: Oct. 5, 1995

[30] Foreign Application Priority Data

Mar. 29, 1994 [GB] United Kingdom ..... 9406258

[51] Int. Cl.[6] ..... B41M 5/035; B41M 5/38

[52] U.S. Cl. ..... 503/227; 428/195; 428/206; 428/324; 428/329; 428/331; 428/913; 428/914

[58] Field of Search ..... 8/471; 428/195, 428/206, 913, 914, 324, 331, 328, 329; 503/227

[56] References Cited

U.S. PATENT DOCUMENTS

| | | | |
|---|---|---|---|
| 5,387,573 | 2/1995 | Oldfield et al. | 503/227 |
| 5,538,831 | 7/1996 | Oshima et al. | 430/201 |

FOREIGN PATENT DOCUMENTS

| | | | |
|---|---|---|---|
| 0 479 295 | 4/1992 | European Pat. Off. | 503/227 |

*Primary Examiner*—Bruce H. Hess

[57] ABSTRACT

A donor sheet for providing a protective cover over a thermally transferred image which comprises a carrier base sheet having a surface coated with a layer of transparent thermally transferable cover material, the cover material comprising a layer of submicron lamina particles and sufficient of a thermoplastic binder to provide the layer with physical integrity and adhesion to the carrier base sheet is disclosed. The lamina particles of the cover material are incorporated to provide a physical barrier for reducing ingress of dye-leaching materials such as grease and plasticizers commonly found in plastic wallets and other such containers.

8 Claims, 1 Drawing Sheet

COVERS FOR THERMAL TRANSFER PRINTS

The invention relates to thermal transfer printing, and especially to thermally transferable protective covers for thermally transferred images.

Thermal transfer printing is a process in which one or more thermally transferable dyes are caused to transfer from selected areas of a dyesheet to a receiver by thermal stimuli, thereby to form an image. Using a dyesheet comprising a thin substrate supporting a dyecoat containing one or more dyes uniformly spread over at least a print size area of the dyesheet, printing is effected by heating selected discrete areas of the dyesheet while the dyecoat is pressed against a dye-receptive surface of a receiver sheet, thereby causing dye to transfer to corresponding areas of the receiver. The shape of the image transferred is determined by the number and locations of the discrete areas which are subjected to heating. Full colour prints can be produced by printing with different coloured dyecoats sequentially in like manner, and the different coloured dyecoats are usually provided as discrete uniform print-size areas arranged in a repeated sequence along a ribbon-shaped dyesheet.

High resolution photograph-like prints can be produced by thermal transfer printing using appropriate printing equipment, such as a programmable thermal print head or laser printer, controlled by electronic signals derived from a video, computer, electronic still camera, or similar signal generating apparatus. A typical thermal print head has a row of tiny selectively energizable heaters, spaced to print six or more pixels per millimetre, often with two heaters per pixel. Laser printers require absorbers to convert the laser radiation to heat, usually in or under the dyecoat, and similarly produce the print by transferring dyes to the receiver pixel by pixel.

The transfer mechanism is believed to depend very much on the conditions under which printing is carried out. Thus for example, when using a thermal head, the dyesheet and receiver are pressed together between the head and a platten roller, giving conditions favouring diffusion of the dyes from the dyesheet directly into the receiver, virtually precluding any sublimation. Where a small gap is provided between the dyesheet and receiver, as favoured in some laser driven printers for example, the transfer mechanism appears to be exclusively sublimation. However, in both cases the dyes are mobile molecules which can diffuse into and out of the receiver when warmed, or in the presence of various lyophilic liquids. In particular, grease from a finger holding a print can lead to migration of the dye to the surface, making the print seem dirty or causing smearing of the dyes, and plasticisers in plastic pouches can cause havoc with unprotected thermal transfer images. Particularly bad in this respect is dioctylphthallate, commonly used as a plasticiser in polyvinyl choride.

For many years various protective covers have been proposed to protect thermal transfer prints against abrasion, loss of dyes migrating to the surface, and protection against UV-induced fading, for example. Very thin covers are generally preferred, typically 1–2 $\mu$m, which are difficult to handle without some form of support, and in the past it has been proposed first to prepare a donor sheet comprising a temporary carrier base sheet having a surface coated with a layer of transparent thermally transferable cover material, then thermally transferring the coating onto the printed receiver and removing the carrier. The transfer can be effected simultaneously over the whole print, and the carrier is then removed after the transfer is complete. Alternatively, transfer may be progressive, e.g. using heated rollers or a thermal head to transfer the cover line by line, and it is then generally more convenient to remove the carrier progressively as it emerges from the rolls or thermal head.

It has been recognised that polymeric compositions having higher Tg values generally provide better protective coatings, but higher Tg values can lose some of the advantages of the lower Tg materials. Thus good barrier materials of high Tg are not always good adhesives, and to overcome this problem, complex coatings consisting of a plurality of layers of differing functions have previously been proposed. For example, multilayer polymeric coatings comprising a layer of barrier material, laminated to a layer of more adhesive material on one side for providing better adhesion to the receiver, and on the other a layer of a less adhesive material to assist in its release from the carrier, has been described in U.S. Pat. No. 4,977,136.

We have now found that by using a high loading of certain minerals to provide the barrier properties in the transferable cover material, we can obtain generally better resistance to greases and plasticisers even without having to use a polymer which itself has a high Tg. This frees the choice of polymer to one which optimises the other required functions, such as adhesion, and enables a simpler, usually single layer, transferable cover to be used, with all the advantages that brings.

According to one aspect of the present invention, a donor sheet for providing a protective cover over a thermally transferred image comprises a carrier base sheet having a surface coated with a layer of transparent thermally transferable cover material, wherein the cover material comprises a layer of submicron lamina particles and sufficient of a thermoplastic binder to provide the layer with physical integrity and adhesion to the carrier base sheet.

By "lamina particles" we mean that the particles are in the form of thin flat platelets. We prefer that the ratio of the area in the plane of the platelet to the square of the thickness, be at least 50:1, and it appears that the higher the value of this ratio, the greater will be the barrier effect. While the circumference of the platelets need not be regular, we prefer that diameters in perpendicular directions within the plane of the sheet, are not too dissimilar, in order to maximise the projected area. Thus diameter ratios less than 10:1 may generally be suitable, but ratios approaching 1:1 would be preferred.

We prefer generally to use minerals whose particle thickness is less than 50 nm, especially minerals which disperse as single primary particles having a thickness less than about 10 nm. However, in practice even the latter materials may prove difficult to disperse fully, remaining partly agglomerated, but where such agglomerations are still less than 50 nm thick, many layers of overlapping platelets are produced even in coatings as thin as 0.5 $\mu$m, thereby retaining the barrier properties of the coating. Preferred cover layers are less than 5 $\mu$m in thickness, and more suitably between 0.5 and 2 $\mu$m in thickness.

In order to obtain sufficient transparency and integrity of the coating, we prefer the particles to be very much smaller than 1 $\mu$m, e.g. with their largest dimensions two orders of magnitude smaller. Transparency can also be enhanced by choosing the particles and binder polymer so as to match their refractive indices, and this may be particularly desirable when the smaller primary particles form agglomerates which are difficult to disperse or provide effective barriers without further dispersion.

It is thought that the tiny platelets lie parallel and overlapping in the thin layer of cover material, and thus provide a lamellate barrier with tortuous path around the edges of the overlapping particles for the grease or plasticiser to travel before it can ingress. Hence the polymer binder is seen as providing a route for the ingressing molecules to travel, so we prefer to use as high a loading of the particles as possible, commensurate with the polymer being sufficient to fulfil its required functions. However, this is a progressive effect which can start to be noticeable at quite low particle concentrations, e.g. 10% w/w, especially where the particles have particularly high area:thickness ratios, but generally we prefer the particles to be present in quantities of at least 50% w/w of the coating, with proportions of at least 70% w/w being particularly preferred whenever possible.

Suitable particles can be found in a number of natural and synthetic minerals, some of which are available as prepared commercial products. Examples include micas, laponites and hectorite clays such as Bentones. In their dry state, such minerals may exist as agglomerations which need to be broken up and dispersed when preparing a composition for coating onto the carrier base sheet. For example, some commercial laponites are free flowing white powders which can contain some particles as large as 250 $\mu$m, but the primary particles into which they are separated when dispersed in the coating composition typically have a thickness of 1 nm and mean diameter of 25 nm, though some may have diameters up to 100 $\mu$m. These are sold commercially as synthetic smectite crystals of sodium lithium magnesium silicate and are available in a range of grades adapted for various purposes.

Examples of these include a range of Laponite powders sold by Laporte, and different grades can be mixed to optimise the viscosity for the coating apparatus used. With such particles at about 70% w/w loading, some haze may be visible in the coating on the donor sheet, but once transferred onto the image, we find the latter may be viewed with good clarity, any haze being not significantly noticeable. Examples of micronised micas include Microfine Materials Ltd's SX400 made from muscovite potassium aluminium silicate, and Magnapearl 2000 from Cornelius Chemicals.

We have evaluated a number of different minerals, including the above two commercial micas and several grades of Laponite powders as detailed more fully in the Examples hereinafter. However, the efficacy in the barrier properties of a transferred cover, whatever mineral is selected, is dependent on the quality of the coating obtained on the donor sheet, and we have found that for preparing dispersions suitable for gravure coating, the Laponite dispersions were more readily tuned to our coater's requirements, than those of the other minerals. Hence they are our preferred materials even on that ground alone.

With the provision of barrier properties being primarily a function of the mineral particles, the polymer may be selected to optimise the binding of the particles into a cohesive coating, and the adhesion of the coating initially to the carrier and, after transfer, to the image containing receiver. However, other factors may be important in selecting the polymer. Where it is intended to laminate the covered image to a security cover sheet (in passports, driving licences, medical cards and security passes, for example), a polymer may be selected which will adhere strongly to such security cover sheet. It will be appreciated, however, that although barrier properties in the polymer may not be a prerequisite in selection of the polymer, this does not preclude the use of polymers having a high Tg and/or good barrier properties from use in the present donor sheets.

The carrier can be any sheet or coated sheet able to withstand the transfer temperatures. Paper can be used, but the thicker the sheet, the more transfer energy is required, and we prefer to use thin polymer films, such as PET film, typically 6 $\mu$m thick or less.

To assist release of the cover material from a thermoplastic carrier base sheet, we prefer that the latter be primed with a cross-linked resin, to prevent fusion between the carrier and the transferring cover material. Such primes, applied effectively in known manner, remain on the carrier as it is stripped off the covered print. Other coatings featuring one or more of the many known release agents or releasing binders, can be provided instead or in addition to the cross-linked prime, but with such materials there is a chance that at least some will transfer with the cover material. This can be undesirable in a number of applications, especially those requiring lamination of the print to a security cover sheet; in the passports, driving licences, medical cards and security passes referred to above, for example. In general, therefore, we prefer to coat the transferable cover material directly onto the primed surface of the carrier base sheet of the donor sheet.

In the past, the transferable covers have included multilayer systems which are transferred in a single action to form a multilayer cover. Examples of these (referred to above as prior art) included one layer of low Tg polymer as an adhesive layer (for adhering to the receiver) and a separate layer of high Tg polymer to provide a barrier. In the present covers, the mineral filler provides the barrier while the binder provides the adhesion, so in general such double layer structure may be avoided, but this does not preclude from the covers of the present invention, a provision of further layers for specific purposes, i.e. to form of a multilayer protective cover.

The donor sheet can be separate from the dyesheet used to prepare the image, although it is often convenient to have this packaged in a form which enables it to be used in the same apparatus as that which prints the image. To have the dyesheet ribbon and the present donor sheet as separate entities, whether used in the same apparatus or not, enables a first printed receiver to be covered while a further image is being formed on a second receiver sheet, thereby saving time.

However, a preferred donor sheet is one which is incorporated into a dyesheet ribbon comprising a substrate supporting different coloured dyecoats provided as discrete uniform print-size panels arranged in a repeated sequence along the ribbon, the carrier base sheet being provided by the substrate of the dyesheet and each sequence of print-size coloured dyecoat panels having a further print-size panel of the thermally transferable cover material according to the present invention.

A preferred dyesheet is one wherein each sequence has a dyecoat of each of the three primary colours and black, then a further panel of the transferable protective cover of the present invention. A useful variant of this is one in which the three primary colour dyecoats comprise a heat stable binder containing a thermally transferable dye which can diffuse into the receiver when heated during printing, and the black dyecoat comprises a fusible binder containing a black colorant. Each of these dyesheet ribbons may also comprise other specialist dyecoats at appropriate positions in the sequence, including a transferable receiver layer at the start of the sequence, for example.

According to a second aspect of the invention, a method for preparing a thermal transfer print comprises forming an image in or on a surface of a receiver by thermally transferring dyes from a dyesheet to the receiver, placing against the image-containing receiver a donor sheet according to the first aspect of the invention, then thermally transferring the cover material onto the receiver to overlie the image, and removing the carrier base sheet.

According to a third aspect of the invention, a thermal transfer print comprises a receiver, a thermally transferred image in or on a surface of the receiver and an overlying protective cover comprising a layer of submicron lamina particles and sufficient of a thermoplastic binder to provide the layer with physical integrity and adhesion to the receiver, according to the first aspect of the invention.

The invention is illustrated by the accompanying drawings, in which.

Figure 1:
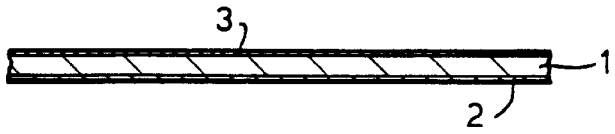
FIG. 1 is a section through a portion of a print size donor sheet.

The donor sheet shown in FIG. 1 consists of a carrier base sheet 1 formed of primed 6 μm PET film having a heat resistant backcoat 2 on one side, and a 1 μm thick layer of transparent thermally transferable cover material 3 coated on the other side. The cover material comprises submicron lamina particles of bentonite in a polymeric binder, their ratio by weight being about 7:3, this amount of binder being sufficient to provide the layer with good integrity and adhesion to the base sheet. The donor sheet is slightly larger than the print which it is designed to cover, and when used it is placed against a thermal transfer image in a receiver layer, and heated to transfer the cover material to overlie the image. The base sheet is then discarded.

Figure 2:
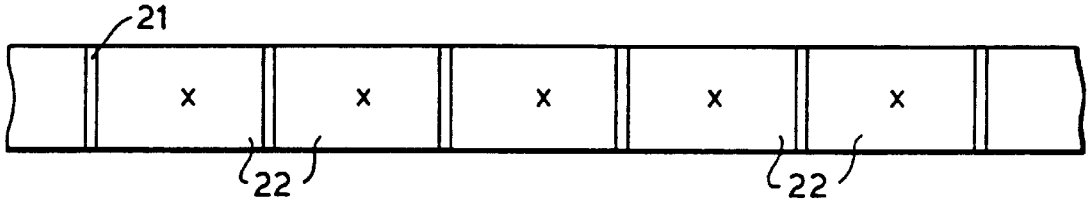
FIG. 2 shows a portion of a donor ribbon incorporating a plurality of cover panels.

In FIG. 2, the base sheet is in the form of a ribbon 21 along which are identical print-size panels 22 of cover material comprising lamina particles dispersed in a binder resin according to the invention. This is capable of covering as many images as there are panels on the ribbon. The prints have to be made elsewhere (though possibly in the same machine), then each has one of the panels superimposed on the image in turn, until all the panels have been transferred. Whereupon the ribbon needs to be replaced for protection of any further images.

Figure 3:
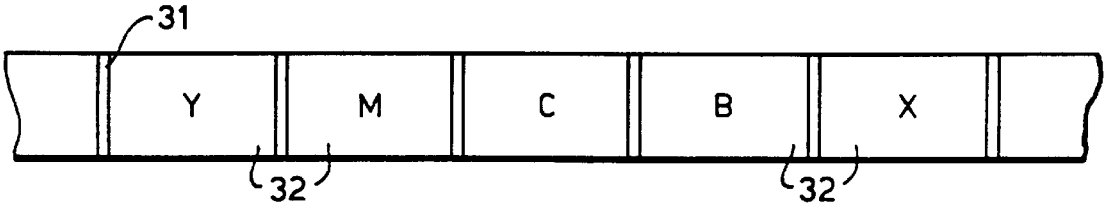
FIG. 3 shows a portion of a dyesheet ribbon incorporating cover panels in its sequence of colour panels.

In FIG. 3, the donor sheet is incorporated into a dyesheet ribbon comprising a substrate ribbon 31 supporting discrete uniform print-size dyecoat panels 32 of each of the three primary colours and black, marked Y, M, C, and B respectively. These are arranged in a repeated sequence along the ribbon in known manner, only a single sequence being shown. However, each sequence of the dyesheet illustrated also has a further print-size panel of a thermally transferable cover material 32X according to the invention, wherein the carrier base sheet is provided by the ribbon substrate of the dyesheet.

Figure 4:
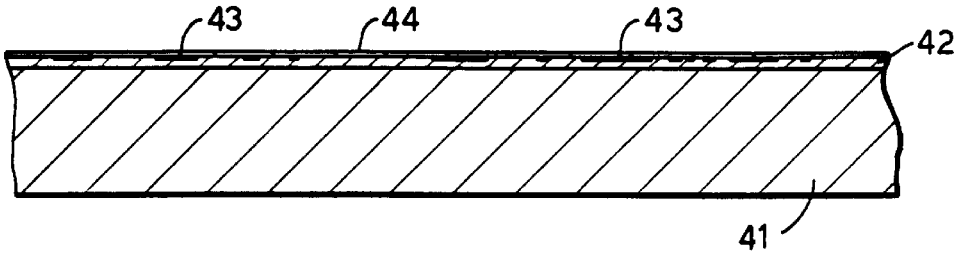
FIG. 4 is a section through a portion of a print having a protective layer according to the invention.

FIG. 4 is a cross section though a print protected by a cover according to the third aspect of the invention. The print comprises a receiver having a base 41 and a dye-receiving layer 42. Diffused into the receiving layer is an image 43 formed of dyes which have been thermally transferred from a dyesheet, and overlying the image is a protective cover 44 comprising a layer of submicron lamina particles and sufficient of a thermoplastic binder to provide the layer with physical integrity and adhesion to the receiving layer 42.

The invention is further illustrated by the following examples:

EXAMPLE 1

The following two dispersions were prepared and coated onto 6 μm subcoated polyester film carrier using a K3 Meier bar and dried at 80° C. for 5 mins giving coatings 1&2 having a dry coat thickness of about 1.5 μm (weight in g).

| Component | Dispersion 1 | Dispersion 2 |
|---|---|---|
| Diofan 193D | 21.82 | 3.64 |
| Laponite XLS | — | 10 |
| distilled water | 78.18 | 192.73 |
| ethanol | 100 | |

(Diofan 193D is a PVDC latex from BASF. It contains 55% PVDC in water, so the ratio of laponite to polymer in this Example was 83% by weight. The Tg of the polymer is about 16° C. Laponite XLS is a layered inorganic filler from Laporte.)

The coatings 1&2 from solutions 1&2 respectively were thermally transferred onto a cyan print (optical density=1) on a polyester based receiver, and the carrier removed. The overlayed samples were assessed for plasticiser protection by storing the images against plasticised PVC sheet (intimate contact maintained under 5 kg load) at 45°/85% relative humidity (RH) for 100 hrs and then measuring the optical density (OD) of the dye which had transferred to the PVC sheet.

| Results: | Sample | OD in PVC |
|---|---|---|
| | Receiver with no protection | 0.76 |
| | Receiver + coating 1 | 0.32 |
| | Receiver + coating 2 | 0.03 |

EXAMPLE 2

The following solutions were prepared and coated onto 6 μm polyester film carrier with a K3 Meier bar and dried at 110° C. for 30 s to give a dry coat thickness of 1 μm (weight in g):

| Component | Dispersion 3 | Dispersion 4 |
|---|---|---|
| Joncryl 8054 | 2.21 | 0.47 |
| Antarox CO 790 | 0.05 | 0.05 |
| Laponite XLS | — | 0.75 |
| Distilled water | 21.7 | 22.8 |

(Joncryl 8054 is a styrene/acrylic copolymer emulsion in water at 43% solids, so the ratio of laponite to polymer in this Example was 79% by weight. The Tg of the polymer was about 105° C. Antarox CO 790 is nonyl phenolethoxylate surfactant.)

The coatings 3 and 4 resulting from dispersions 3 and 4 respectively were then thermally transferred onto a cyan print on PVC receiver (OD=1), and the carrier removed. The overlayed samples were assessed for plasticiser protection by storing the images against plasticised PVC sheet (intimate contact maintained under 5 kg load) at 45°/85% RH for 16 hrs and then measuring the OD of the dye which had transferred to the PVC sheet.

| Results: | Sample | OD in PVC |
|---|---|---|
| | Receiver with no protection | 0.186 |
| | Receiver + coating 3 | 0.063 |
| | Receiver + coating 4 | 0.021 |

Both examples show the improvement in protection obtained by incorporating laponite XLS into the overlay structure.

EXAMPLE 3

The following dispersions were coated by direct gravure onto subcoated 6 μm polyester carrier base (weight in g):

| Component | Dispersion 5 | Dispersion 6 | Dispersion 7 |
|---|---|---|---|
| Diofan 193D | 60.6 | 121.2 | 161.6 |
| Laponite RDS | 166.7 | 133.3 | 111.1 |
| Water | 1667 | 1639.7 | 1621.5 |
| EtOH | 200 | 90 | 250 |

(Laponite RDS is a layered inorganic filler from Laporte.)

Dry coat thicknesses laid down were 0.84 μm, 0.7 μm, and 0.61 μm respectively. Diofan 193D contains 55% PVDC in water, so the ratios of laponite to polymer in the samples were 5:1, 2:1, and 5:4; i.e. 83, 67, and 56% by weight of the cover material respectively.

The coatings were thermally transferred onto cyan panels as in the previous examples, being pressed against plasticised PVC film for 96 hrs at 45 C./85% RH. The OD of dye transferred to the PVC film was then measured in transmission using a Sakura densitometer operating with a red filter, and the readings compared with unprotected samples.

| Results: | Sample | Protected | Unprotected |
|---|---|---|---|
| | 5 | 0.02 | 0.5 |
| | 6 | 0.07 | 0.5 |
| | 7 | 0.04 | 0.63 |

EXAMPLE 4

The following dispersions were formulated to explore the effect of changing the proportion of filler in the cover material. In these, two different grades of Laponite were used to tune the coating characteristics of the dispersion to suit the coating apparatus being used. Thus while Laponite RDS gives a very stable dispersion, the addition of Laponite JS enables the viscosity of the resultant composition to be reduced to the required level.

| Component | Dispersions | | | | | | |
|---|---|---|---|---|---|---|---|
| | 8 | 9 | 10 | 11 | 12 | 13 | 14 |
| water (g) | 294.3 | 303.0 | 303.0 | 303.0 | 303.0 | 303.0 | 288.5 |
| Laponite RDS | 13.6 | 12.6 | 12.1 | 11.4 | 10.0 | 7.7 | 12.0 |
| Laponite JS | 61.9 | 57.6 | 55.2 | 51.7 | 45.8 | 35.0 | 54.8 |
| Diofan 185D | 27.4 | 25.5 | 30.6 | 38.2 | 50.8 | 77.5 | — |
| Diofan DS2319X | — | — | — | — | — | — | 66.8 |
| Tamol 9104 | 1.1 | 1.0 | 0.9 | 0.9 | 0.8 | 0.6 | 0.9 |
| PVA | — | 2.11 | 2.02 | 1.89 | 1.68 | 1.28 | 1.1 |

The above dispersions were gravure coated onto 6 μm subcoated polyester base sheet, dried and evaluated as described in Example 3, except that the time in contact with the PVC film was 100 hrs.

| Results: | sample | filler:binder ratio | filler % | 100 hr plasticiser protection test (OD in pouch) |
|---|---|---|---|---|
| | 8 | 5 | 83 | 0.02 |
| | 9 | 5 | 83 | 0.03 |
| | 10 | 4 | 80 | 0.03 |
| | 11 | 3 | 75 | 0.02 |
| | 12 | 2 | 66 | 0.03 |
| | 13 | 1 | 50 | 0.08 |
| | 14 | 1 | 50 | 0.1 |
| | 15 | 0 | 0 | 0.38 (No protection) |

where the % column gives the filler content as its % by weight of the cover material.

These results demonstrate how, on reducing the filler level to slightly above 50% of the composition by weight, the protection afforded started to fall, and while still acceptable for many purposes at 50%, such compositions are clearly less effective than those of 66% and above.

We claim:

1. A donor sheet for providing a protective cover over a thermally transferred image, the donor sheet comprising a carrier base sheet having a surface coated with a layer of thermally transferable cover material, wherein:

the cover material comprises a layer of submicron lamina particles and a sufficient amount of a thermoplastic binder to provide the layer with physical integrity and adhesion to the carrier base sheet;

the particles are in the form of thin flat platelets having a ratio of area of the platelet in the plane of the platelet to the square of the platelet thickness of at least 50 to 1, and the platelet thickness is less than 50 nm; and the particles comprise at least 50% by weight of the cover material, wherein the particles act to provide a physical barrier for reducing ingress of grease and plasticizers into the transferred cover material.

2. A donor sheet as claimed in claim 1 wherein the particles are selected from micas, laponites and hectorite clays.

3. A donor sheet as claimed in claim 1 wherein the layer of cover material is between 0.5 and 2 μm thick.

4. A donor sheet as claimed in claim 1 which is incorporated into a dyesheet ribbon comprising a substrate supporting different coloured dyecoats provided as discrete uniform print-size panels arranged in a repeated sequence along the ribbon, the carrier base sheet being provided by the substrate of the dyesheet and each sequence of print-size coloured dyecoat panels having a further print-size panel of the thermally transferable cover material.

5. A donor sheet as claimed in claim 4 wherein each sequence has a dyecoat of each of the three primary colours and black, then the further panel of thermally transferable cover material.

6. A method for preparing a thermal transfer print which comprises forming an image in or on a surface of a receiver by thermally transferring dyes from a dyesheet to the receiver, placing against the image-containing receiver a donor sheet as claimed in claim 1, thermally transferring the cover material onto the receiver to overlie the image, and removing the carrier base sheet.

7. A thermal transfer print comprising a receiver, a thermally transferred image in or on a surface of the receiver and an overlying protective cover comprising a layer of submicron lamina particles and sufficient of a thermoplastic binder to provide the layer with physical integrity and adhesion to the receiver as claimed in claim 1.

8. The donor sheet of claim 1 in which the particles comprise at least 70% by weight of the cover material.

* * * * *